US008846593B2

(12) United States Patent
Hueffer et al.

(10) Patent No.: US 8,846,593 B2
(45) Date of Patent: Sep. 30, 2014

(54) DISHWASHING COMPOSITION COMPRISING A COVALENTLY MODIFIED ALKYLENEIMINE POLYMER

(71) Applicant: BASF SE, Ludwigshafen (DE)

(72) Inventors: Stephan Hueffer, Ludwigshafen (DE); Alejandra Garcia Marcos, Ludwigshafen (DE); Markus Hartmann, Neustadt (DE); Heike Weber, Mannheim (DE); Mario Emmeluth, Bensheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/869,111

(22) Filed: Apr. 24, 2013

(65) Prior Publication Data

US 2013/0288941 A1 Oct. 31, 2013

Related U.S. Application Data

(60) Provisional application No. 61/637,901, filed on Apr. 25, 2012.

(30) Foreign Application Priority Data

May 15, 2012 (EP) ..... 12168038

(51) Int. Cl.

| | |
|---|---|
| ***C11D 3/30*** | (2006.01) |
| ***C11D 11/00*** | (2006.01) |
| ***C11D 11/02*** | (2006.01) |
| ***C11D 3/37*** | (2006.01) |
| ***C11D 3/33*** | (2006.01) |

(52) U.S. Cl.

CPC ..... *C11D 3/3723* (2013.01); *C11D 11/0082* (2013.01); *C11D 11/02* (2013.01); *C11D 3/33* (2013.01)

USPC ..... 510/223; 510/220; 510/229; 510/230; 510/235; 510/480; 510/499

(58) Field of Classification Search

USPC ..... 510/220, 223, 229, 230, 235, 480, 499

See application file for complete search history.

(56) References Cited

U.S. PATENT DOCUMENTS

| | | | | |
|---|---|---|---|---|
| 6,300,305 | B1 * | 10/2001 | Huff et al. | 510/475 |
| 2004/0139559 | A1 * | 7/2004 | Detering et al. | 8/181 |
| 2005/0015888 | A1 * | 1/2005 | Altmann et al. | 8/115.51 |
| 2007/0155646 | A1 | 7/2007 | Becker et al. | |
| 2009/0007936 | A1 * | 1/2009 | Uhl et al. | 134/6 |
| 2011/0183883 | A1 | 7/2011 | Hahn et al. | |
| 2012/0138089 | A1 | 6/2012 | Uhl et al. | |
| 2013/0102514 | A1 | 4/2013 | Hueffer et al. | |
| 2013/0102515 | A1 | 4/2013 | Hueffer et al. | |
| 2013/0102516 | A1 | 4/2013 | Hueffer et al. | |

FOREIGN PATENT DOCUMENTS

| | | | |
|---|---|---|---|
| DE | 198 19 187 | A1 | 11/1999 |
| EP | 0 851 023 | A2 | 7/1998 |
| JP | 2006-335908 | | 12/2006 |
| WO | WO 99/05248 | A1 | 2/1999 |
| WO | WO 01/96516 | A1 | 12/2001 |
| WO | WO 02/064719 | A1 | 8/2002 |
| WO | WO 2005/073357 | A2 | 8/2005 |
| WO | WO 2006/108857 | A1 | 10/2006 |
| WO | WO 2007/054126 | A1 | 5/2007 |
| WO | WO 2009/092699 | A1 | 7/2009 |
| WO | WO 2010/020765 | A1 | 2/2010 |

OTHER PUBLICATIONS

Search Report issued Oct. 18, 2012 in European Patent Application No. EP 12 16 5550 (with English translation of Category of Cited Documents).

U.S. Appl. No. 13/866,350, filed Apr. 19, 2013, Hueffer, et al.

U.S. Appl. No. 13/870,206, filed Apr. 25, 2013, Garcia Marcos, et al.

International Search Report issued Sep. 13, 2013 in PCT/EP2013/058311 (with English translation of category of cited documents).

* cited by examiner

*Primary Examiner* — Charles Boyer

(74) *Attorney, Agent, or Firm* — Oblon, Spivak, McClelland, Maier & Neustadt, L.L.P.

(57) ABSTRACT

The present invention relates to formulations comprising (A) at least one aminocarboxylate, selected from methylglycine diacetate (MGDA), iminodisuccinic acid (IDA) and glutaminic acid diacetate (GLDA), and salts and derivatives thereof, and (B) at least one alkyleneimine polymer which is covalently modified with at least one carboxylic acid or at least one derivative of a carboxylic acid or at least one derivative of carbonic acid, where up to at most 75 mol % of the nitrogen atoms of the primary and secondary amino groups of the alkyleneimine polymer have been reacted with carboxylic acid or derivative of carboxylic acid or carbonic acid.

14 Claims, No Drawings

DISHWASHING COMPOSITION COMPRISING A COVALENTLY MODIFIED ALKYLENEIMINE POLYMER

CROSS REFERENCE TO RELATED APPLICATIONS

The present application claims the benefit of U.S. Provisional Application No. 61/637,901, filed on Apr. 25, 2012, which is herein incorporated by reference in its entirety, and claims priority to European Patent Application No. 12168038.3, filed on May 15, 2012.

The present invention relates to formulations comprising (A) at least one aminocarboxylate, selected from methylglycine diacetate (MGDA), iminodisuccinic acid (IDA) and glutaminic acid diacetate (GLDA), and salts thereof, and (B) at least one alkyleneimine polymer which is covalently modified with at least one carboxylic acid or at least one derivative of a carboxylic acid or at least one derivative of carbonic acid, where up to at most 75 mol % of the nitrogen atoms of the primary and secondary amino groups of the alkyleneimine polymer have been reacted with carboxylic acid or derivative of carboxylic acid or carbonic acid.

Furthermore, the present invention relates to a process for the preparation of formulations according to the invention and their use as or for producing dishwashing compositions, in particular dishwashing compositions for machine dishwashing.

Dishwashing compositions have to satisfy many requirements. Thus, they have to fundamentally clean the dishes, they should have no harmful or potentially harmful substances in the waste water, they should permit the run-off and drying of the water from the dishes, and they should not lead to problems during operation of the dishwasher. Finally, they should not lead to esthetically undesired consequences on the ware to be cleaned. In this connection, mention is to be made particularly of glass corrosion.

Glass corrosion arises not only as the result of mechanical effects, for example by glasses rubbing together or mechanical contact of the glasses with parts of the dishwasher, but is primarily caused by chemical effects. For example, certain ions can be dissolved out of the glass through repeated machine washing, which changes the optical and thus the esthetic properties in an adverse manner.

In the event of glass corrosion, several effects are observed. Firstly, the formation of microscopically fine cracks can be observed, which become noticeable in the form of lines. Secondly, in many cases, a general hazing can be observed, for example a roughening, which makes the glass in question appear unattractive. Effects of this type are overall also subdivided into iridescent discoloration, formation of ridges, and also sheet-like and ring-like hazing.

It is known from WO 2002/64719 that certain copolymers of ethylenically unsaturated carboxylic acids with, for example, esters of ethylenically unsaturated carboxylic acids can be used in dishwashing compositions.

WO 2006/108857 discloses alkoxylated polyethyleneimines as additives to detergents. By way of example, detergents are disclosed which comprise zeolites or polyaminocarboxylates such as EDTA or triethylenediamine pentaacetate as complexing agents.

WO 01/96516 proposes formulations which comprise alkoxylated polyethyleneimine for cleaning hard surfaces. Purified water is used for rinsing.

WO 2010/020765 discloses dishwashing compositions which comprise polyethyleneimine. Dishwashing compositions of this type can comprise phosphate or be phosphate-free. They are attributed good inhibition of glass corrosion. Zinc- and bismuth-containing dishwashing compositions are advised against. However, in many cases, the glass corrosion, in particular the line corrosion and the hazing, is not adequately delayed or prevented.

It was thus the object to provide formulations which are suitable as or for producing dishwashing compositions and which avoid the disadvantages known from the prior art and inhibit glass corrosion or at least reduce it particularly well. It was also the object to provide a process for the preparation of formulations which are suitable as or for producing dishwashing compositions and which avoid the disadvantages known from the prior art. It was also the object to provide uses of formulations.

Accordingly, the formulations defined at the start have been found, also abbreviated to formulations according to the invention.

Formulations according to the invention comprise (A) at least one aminocarboxylate selected from methylglycine diacetate (MGDA), iminodisuccinic acid (IDA) and glutamic acid diacetate (GLDA), and salts thereof, within the context of the present invention also abbreviated to aminocarboxylate (A) or else compound (A).

Compound (A) is preferably selected as free acid, particularly preferably in partially or completely neutralized form, i.e. as salt. Suitable counterions are, for example, inorganic cations, for example ammonium, alkali metal or alkaline earth metal, preferably $Mg^{2+}$, $Ca^{2+}$, $Na^{+}$, $K^{+}$, or organic cations, preferably ammonium substituted with one or more organic radicals, in particular triethanolammonium, N,N-diethanolammonium, N-mono-$C_1$-$C_4$-alkyldiethanolammonium, for example N-methyldiethanolammonium or N-n-butyldiethanolammonium, and N,N-di-$C_1$-$C_4$-alkylethanolammonium.

Very particularly preferred compounds (A) are the alkalki metal salts, in particular the sodium salts of methylglycine diacetate (MGDA), iminosuccinic acid (IDA) and glutaminic acid diacetate (GLDA).

Very particularly preferably, methylglycine diacetate (MGDA), iminosuccinic acid (IDA) or glutaminic acid diacetate (GLDA) is completely neutralized.

Furthermore, formulations according to the invention comprise (B) at least one alkyleneimine polymer which is covalently modified with at least one carboxylic acid or at least one derivative of a carboxylic acid or at least one derivative of carbonic acid, also called modified polyalkyleneimine (B) for short, where up to at most 75 mol % of the nitrogen atoms of the primary and secondary amino groups of the alkyleneimine polymer have been reacted with carboxylic acid or derivative of carboxylic acid or carbonic acid.

Within the context of the present invention, alkyleneimine polymers are to be understood as meaning those polymeric materials which are obtained by homo- or copolymerization of one or more cyclic imines, or by grafting a (co)polymer with at least one cyclic imine. Examples are polyalkylenepolyamines and polyimidoamines grafted with ethyleneimine.

Within the context of the present invention, polyalkylenepolyamines are preferably understood as meaning those polymers which comprise at least 6 nitrogen atoms and at least five $C_2$-$C_{10}$-alkylene units, preferably $C_2$-$C_3$-alkylene units, per molecule, for example pentaethylenehexamine, and in particular polyethyleneimines.

Polyalkylenepolyamine and in particular polyethyleneimine can, for example, have an average molecular weight ($M_w$) of at least 300 g/mol; preferably, the average molecular weight of alkyleneimine polymer is in the range from 500 to 1000000 g/mol, particularly preferably 800 to 25000 g/mol, ascertained by gel permeation chromatography (GPC).

Polyalkylenepolyamines can be covalently modified in partially quaternized (alkylated) form as alkyleneimine polymer. Suitable quaternizing agents (alkylating agents) are, for example, alkyl halides, in particular $C_1$-$C_{10}$-alkyl chloride, such as methyl chloride, methyl bromide, methyl iodide, ethyl chloride, ethyl bromide, n-butyl chloride, tert-butyl chloride, n-hexyl chloride, also epichlorohydrin, dimethyl sulfate, diethyl sulfate and benzyl chloride. If quaternized (alkylated) polyalkylenepolyamines as alkyleneimine polymer are covalently modified, the degree of quaternization (alkylation) is preferably 1 to 25, particularly preferably up to 20 mol %, based on quaternizable (alkylatable) N atoms in alkyleneimine polymer.

Furthermore, polyalkylenepolyamines and in particular polyethyleneimines can be covalently modified in partially $C_2$-$C_{22}$-epoxide-alkoxylated form as alkyleneimine polymer. Examples of suitable $C_2$-$C_{22}$-epoxides are ethylene oxide, propylene oxide, n-hexylene oxide, styrene oxide. If polyalkylenepolyamines partially alkoxylated with $C_2$-$C_{22}$-epoxides as alkyleneimine polymer are covalently modified, the degree of alkoxylation is preferably 1 to 25, particularly preferably up to 20 mol %, based on alkoxylatable N atoms in the alkyleneimine polymer in question.

Furthermore, polyamidoamines grafted with ethyleneimine are suitable as alkyleneimine polymers. Suitable polyamidoamines are obtainable for example by reacting $C_4$-$C_{10}$-dicarboxylic acids with polyalkylenepolyamines which preferably comprise 3 to 10 basic nitrogen atoms in the molecule. Suitable dicarboxylic acids are, for example, succinic acid, maleic acid, adipic acid, glutaric acid, suberic acid, sebacic acid or terephthalic acid. It is also possible to use mixtures of the aforementioned dicarboxylic acids, for example mixtures of adipic acid and glutaric acid or mixtures of maleic acid and adipic acid. Preference is given to using adipic acid for producing polyamidoamines. Suitable polyalkylenepolyamines which have been condensed with the aforementioned dicarboxylic acids are, for example, diethylenetriamine, triethylenetetramine, dipropylenetriamine, tripropylenetetramine, dihexamethylenetriamine, aminopropylethylenediamine and bis-aminopropylethylenediamine. Aforementioned polyalkylenepolyamines can also be used in the form of mixtures in the preparation of polyamidoamine. The preparation of polyamidoamine preferably takes place without dilution, but can optionally also be carried out in inert solvents. The condensation of dicarboxylic acid with polyalkylenepolyamine takes place at elevated temperatures, for example in the range from 120 to 220° C. The water formed during the reaction is distilled off from the reaction mixture. The condensation can optionally be carried out in the presence of lactones or lactams of carboxylic acids having 4 to 8 carbon atoms. In general, 0.8 to 1.4 mol of polyalkylenepolyamine are used per mole of dicarboxylic acid. Polyamidoamines obtainable in this way have primary and secondary NH groups and are soluble in water.

Polyamidoamines grafted with ethyleneimine can be prepared by allowing ethyleneimine to act on the polyamidoamine described above in the presence of Brönstedt acids or Lewis acids, for example sulfuric acid, phosphoric acid or boron trifluoride etherate. As a result, ethyleneimine is grafted onto the polyamidoamine in question. For example, 1 to 10 ethyleneimine units can be grafted on per basic nitrogen atom in the polyamidoamine, i.e. about 10 to 500 parts by weight of ethyleneimine are used per 100 parts by weight of polyamidoamine.

A preferred alkyleneimine polymer is polyethyleneimine.

In one embodiment of the present invention, polyethyleneimine has an average molecular weight $M_w$ in the range from 500 to 1000000 g/mol, preferably in the range from 600 to 75000 g/mol, particularly preferably in the range from 800 to 25000 g/mol, determinable for example by gel permeation chromatography (GPC).

In one embodiment of the present invention, polyethyleneimines are selected from highly branched polyethyleneimines. Highly branched polyethyleneimines are characterized by their high degree of branching (DB). The degree of branching can be determined, for example, by $^{13}$C-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to the fraction of primary amino groups.

Within the context of the present invention, highly branched polyethyleneimines are polyethyleneimines with DB in the range from 0.1 to 0.95, preferably 0.25 to 0.90, particularly preferably in the range from 0.30 to 0.80 and very particularly preferably at least 0.5.

In one embodiment of the present invention, the polyethyleneimine is highly branched polyethyleneimines (homopolymers) with an average molecular weight $M_w$ in the range from 600 to 75000 g/mol, preferably in the range from 800 to 25000 g/mol.

Within the context of the present invention, alkyleneimine polymer is used in covalently modified form, and specifically such that in total up to at most 75 mol %, preferably in total 5 to 60 mol %, of the nitrogen atoms of the primary and secondary amino groups of the alkyleneimine polymer have been reacted with at least one carboxylic acid or at least one derivative of a carboxylic acid or at least one derivative of carbonic acid. Within the context of the present application, the reaction (modification) can thus be, for example, an alkylation or an amidation.

In one embodiment of the present invention, modified polyalkyleneimine (B) is selected from alkyleneimine polymers and in particular polyethyleneimines (B1) which have been reacted with at least one ethylenically unsaturated $C_3$-$C_{10}$ carboxylic acid or (B2) which have been reacted with at least one $C_5$-$C_{12}$-carboxylic acid which has no ethylenic double bond, (B3) which have been reacted with at least one carbonic acid ester and (B4) which have been reacted with hydrocyanic acid and formaldehyde, for example in the sense of a Strecker synthesis.

Examples of ethylenically unsaturated $C_3$-$C_{10}$-carboxylic acids are unsaturated fatty acids and preferably α,β-ethylenically unsaturated $C_3$-$C_{10}$-carboxylic acids, for example (E)- or (Z)-crotonic acid, methacrylic acid and in particular acrylic acid. As a result of a reaction with $C_3$-$C_{10}$-carboxylic acid(s), $C_3$-$C_{10}$-carboxylic acid(s) is/are added onto nitrogen atoms from $NH_2$ groups or NH groups from alkyleneimine polymer preferably in the sense of a Michael addition.

Examples of $C_5$-$C_{12}$-carboxylic acid which have no ethylenic double bond are valeric acid, caproic acid, caprylic acid, n-octanoic acid, n-decanoic acid and lauric acid. As a result of a reaction with $C_5$-$C_{12}$-carboxylic acid(s) which have no ethylenic double bond, an amidation of nitrogen atoms from $NH_2$ groups or NH groups from alkyleneimine polymer is preferably carried out.

Examples of derivatives of $C_5$-$C_{12}$-carboxylic acids which have no ethylenic double bond are esters thereof, for example the $C_1$-$C_4$-alkylesters, in particular the ethyl and the methylesters. Examples are methyl valerate, methyl caproate, methyl caprylate, methyl n-octanoate, methyl n-decanoate, ethyl valerate, ethyl caproate, ethyl caprylate, ethyl n-octanoate and ethyl n-decanoate.

Examples of carbonic acid derivatives are the di-$C_1$-$C_2$-alkyl esters of carbonic acid, such as dimethyl carbonate, diethyl carbonate and ethylmethyl carbonate, and in particular cyclic carbonates such as ethylene carbonate and propylene carbonate. Preference is given to ethylene carbonate.

In this connection, in modified polyalkyleneimine (B), up to in total at most 75 mol % of the nitrogen atoms of the primary and secondary amino groups of the alkyleneimine polymer have been reacted with carboxylic acid or derivative of carboxylic acid or carbonic acid, preferably in total 5 to 60 mol %.

Tertiary nitrogen atoms in polyalkyleneimine (B) have generally not been reacted with carboxylic acid or derivative of carboxylic acid or carbonic acid.

In another embodiment of the present invention, modified polyalkyleneimine (B) which is obtainable from alkyleneimine polymers and in particular polyethyleneimines (B1) which have been reacted with at least one ethylenically unsaturated $C_3$-$C_{10}$-carboxylic acid is used in formulation according to the invention as free acid.

Modified polyalkyleneimine (B) can have, as counterions, high molecular weight or low molecular weight anions, organic or preferably inorganic. Within the context of the present invention, high molecular weight anions have an average molecular weight of 200 g/mol or more, for example up to 2500 g/mol, low molecular weight anions have a molecular weight of less than 200 g/mol, for example from 17 to 150 g/mol. Examples of low molecular weight organic counterions are acetate, propionate and benzoate. Examples of low molecular weight inorganic counterions are sulfate, chloride, bromide, hydroxide, carbonate, methanesulfonate and hydrogencarbonate.

In one embodiment of the present invention, modified polyalkyleneimine (B) has a cationic charge density of at least 5 meq/g (milliequivalents/g), preferably 5 to 22 meq/g, the data in g referring to modified polyalkyleneimine (B) without taking into consideration the counterions. The cationic charge density can be ascertained for example by titration, for example by titration with polyvinyl sulfate.

Modified polyalkyleneimines (B) can also comprise one or more anionic comonomers in copolymerized form, for example (meth)acrylic acid. Cationic polymers (B) which also comprise one or more anionic comonomers in copolymerized form, however, have more cationic c than anionic charges per molecule.

In one embodiment of the present invention, modified polyalkyleneimine (B) has a molecular weight distribution $M_w/M_n$ in the range from 1.1 to 10, preferably 1.5 to 5.

In one embodiment of the present invention, modified polyalkyleneimine (B) has a molecular weight Mw in the range from 550 to $1.5 \cdot 10^6$ g/mol.

In one embodiment of the present invention, formulations according to the invention comprise in total in the range from 1 to 50% by weight of aminocarboxylate (A), preferably 10 to 25% by weight, in total in the range from 0.001 to 5% by weight of modified polyalkyleneimine (B), preferably 0.05 to 2.5% by weight, based in each case on solids content of the formulation in question.

In one variant of the present invention, formulation according to the invention comprises compound (A) and modified polyalkyleneimine (B) in a weight ratio of from 1000:1 to 25:1.

In a preferred embodiment of the present invention, formulation according to the invention is free from phosphates and polyphosphates, with hydrogen phosphates being subsumed therewith, for example free from trisodium phosphate, pentasodium tripolyphosphate and hexasodium metaphosphate. "Free from" in connection with phosphates and polyphosphates is to be understood as meaning, within the context of the present invention, that the content of phosphate and polyphosphate in total is in the range from 10 ppm to 0.2% by weight, determined by gravimetry.

Formulations according to the invention can comprise further components which are advantageous for example for use when washing dishes and/or kitchen utensils.

In another embodiment of the present invention, formulations according to the invention comprise no further components which are advantageous for example for use when washing dishes and/or kitchen utensils, but can be readily formulated with further components and are therefore suitable as starting material.

In one embodiment of the present invention, formulations according to the invention comprise sodium citrate (C). In this connection, the term sodium citrate includes the monosodium salt and preferably the disodium salt. Sodium citrate can be used as anhydrous salt or as hydrate, for example as dihydrate.

In one embodiment of the present invention, formulations according to the invention comprise (D) at least one compound selected from alkali metal percarbonate, alkali metal perborate and alkali metal persulfate, within the context of the present invention also called "bleach (D)".

Preferred bleaches (D) are selected from sodium perborate, anhydrous or, for example, as monohydrate or as tetrahydrate or so-called dihydrate, sodium percarbonate, anhydrous or, for example, as monohydrate, and sodium persulfate, the term "persulfate" in each case including the salt of the peracid $H_2SO_5$ and also the peroxodisulfate.

In this connection, the alkali metal salts can in each case also be alkali metal hydrogen carbonate, alkali metal hydrogen perborate and alkali metal hydrogen persulfate. However, preference is given in each case to the dialkyl metal salts.

In one embodiment of the present invention, formulation according to the invention comprises 0 to 50% by weight of sodium citrate (C), preferably 1 to 30% by weight, particularly preferably at least 5% by weight of sodium citrate (C), determined as anhydrous sodium citrate, in total zero to 15% by weight of bleach (D), preferably at least 0.5% by weight of bleach (D) selected from alkali metal percarbonate, alkali metal perborate and alkali metal persulfate, based in each case on solids content of the formulation in question.

In one embodiment of the present invention, formulation according to the invention is solid at room temperature, for example a powder or a tablet. In another embodiment of the present invention, formulation according to the invention is liquid at room temperature. In one embodiment of the present invention, formulation according to the invention is granules, a liquid preparation or a gel.

In one embodiment of the present invention, formulation according to the invention comprises 0.1 to 10% by weight of water, based on the sum of all solids of the formulation in question.

In one embodiment of the present invention, formulation according to the invention is free from those heavy metal compounds which do not act as bleach catalysts, in particular from compounds of iron and of bismuth. In connection with heavy metal compounds, "free from" is to be understood as meaning, within the context of the present invention, that the content of heavy metal compounds which do not act as bleach catalysts is in total in the range from 0 to 100 ppm, determined in accordance with the Leach method and based on the solids content. Preferably, formulation according to the invention has a heavy metal content below 0.05 ppm, based on the solids content of the formulation in question.

Within the context of the present invention, "heavy metals" are all metals with a specific density of at least 6 g/cm$^3$. In particular, heavy metals are precious metals and also zinc, bismuth, iron, copper, lead, tin, nickel, cadmium and chromium.

Preferably, formulation according to the invention comprises no measurable fractions of zinc and bismuth compounds, i.e. for example less than 1 ppm.

In one embodiment of the present invention, formulation according to the invention can have further ingredients (E), for example one or more surfactants, one or more enzymes, one or more builders, in particular phosphorus-free builders, one or more cobuilders, one or more alkali metal carriers, one or more bleaches, one or more bleach catalysts, one or more bleach activators, one or more bleach stabilizers, one or more antifoams, one or more corrosion inhibitors, one or more builders, buffers, dyes, one or more fragrances, one or more organic solvents, one or more tableting auxiliaries, one or more disintegrants, one or more thickeners, or one or more solubility promoters.

Examples of surfactants are in particular nonionic surfactants and also mixtures of anionic or zwitterionic surfactants with nonionic surfactants. Preferred nonionic surfactants are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (I)

(I)

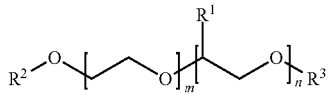

in which the variables are defined as follows:

$R^1$ is identical or different and selected from linear $C_1$-$C_{10}$-alkyl, preferably in each case identical and ethyl and particularly preferably methyl, $R^2$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec.-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Here, compounds of the general formula (I) may be block copolymers or random copolymers, preferably block copolymers.

Other preferred examples of alkoxylated alcohols and alkoxylated fatty alcohols are, for example, compounds of the general formula (II)

(II)

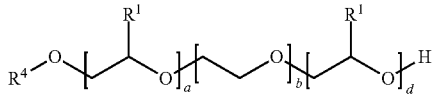

in which the variables are defined as follows:

$R^1$ is identical or different and selected from linear $C_1$-$C_{10}$-alkyl, preferably in each case identical and ethyl and particularly preferably methyl, $R^4$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from 1 to 6, b is a number in the range from 4 to 20, d is a number in the range from 4 to 25.

Here, compounds of the general formula (II) can be block copolymers or random copolymers, preferably block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

Mixtures of two or more different nonionic surfactants may also be present.

Examples of anionic surfactants are $C_8$-$C_{20}$-alkyl sulfates, $C_8$-$C_{20}$-alkylsulfonates and $C_8$-$C_{20}$-alkyl ether sulfates with one to 6 ethylene oxide units per molecule.

In one embodiment of the present invention, formulation according to the invention can comprise in the range from 3 to 20% by weight surfactant.

Formulations according to the invention can comprise one or more enzymes. Examples of enzymes are lipases, hydrolases, amylases, proteases, cellulases, esterases, pectinases, lactases and peroxidases.

Formulations according to the invention can comprise, for example, up to 5% by weight of enzyme, preferably 0.1 to 3% by weight, in each case based on the total solids content of the formulation according to the invention.

Besides sodium citrate (C), formulations according to the invention can comprise one or more builders, in particular phosphate-free builders. Examples of suitable builders are silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers. Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40000 g/mol. preferably 2000 to 10000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilically or hydrophobically modified monomer, as listed below.

Suitable hydrophobic monomers are, for example, isobutene, diisobutene, butene, pentene, hexene and styrene, olefins having 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-α-olefin, a mixture of $C_{20}$-$C_{24}$-α-olefins and polyisobutene having, on average, 12 to 100 carbon atoms per molecule.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol(meth)acrylate, methoxypolypropylene glycol(meth)acrylate, methoxypolybutylene glycol(meth)acrylate, methoxypoly(propylene oxide-co-ethylene oxide)(meth)acrylate, ethoxypolyethylene glycol (meth)acrylate, ethoxypolypropylene glycol(meth)acrylate, ethoxypolybutylene glycol(meth)acrylate and ethoxypoly (propylene oxide-co-ethylene oxide)(meth)acrylate. Polyalkylene glycols here can comprise 3 to 50, in particular 5 to 40 and especially 10 to 30 alkylene oxide units per molecule.

Particularly preferred monomers containing sulfonic acid groups here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as their sodium, potassium or ammonium salts.

Particularly preferred monomers containing phosphonate groups are vinylphosphonic acid and its salts.

Moreover, amphoteric polymers can also be used as builders.

Formulations according to the invention can comprise, for example, in the range from in total 10 to 50% by weight, preferably up to 20% by weight, of builders.

In one embodiment of the present invention, formulations according to the invention can comprise one or more cobuilders.

Examples of cobuilders are phosphonates, for example hydroxyalkanephosphonates and aminoalkanephosphonates. Among the hydroxyalkanephosphonates, the 1-hydroxyethane-1,1-diphosphonate (HEDP) is of particular importance as cobuilder. It is preferably used as sodium salt, the disodium salt being neutral and the tetrasodium salt being alkaline (pH 9). Suitable aminoalkanephosphonates are preferably ethylenediaminetetramethylenephosphonate (EDTMP), diethylenetriaminepentamethylenphosphonate (DTPMP), and also their higher homologues. They are preferably used in the form of the neutrally reacting sodium salts, e.g. as hexasodium salt of the EDTMP or as hepta- and octa-sodium salts of the DTPMP.

Formulations according to the invention can comprise one or more alkali carriers. Alkali carriers provide, for example, for the pH of at least 9 if an alkaline pH is desired. For example, alkali metal carbonates, alkali metal hydrogen carbonates, alkali metal hydroxides and alkali metal metasilicates are suitable. A preferred alkali metal is in each case potassium, particular preference being given to sodium.

In addition to bleaches (D), formulations according to the invention can comprise one or more chlorine-containing bleaches.

Suitable chlorine-containing bleaches are, for example, 1,3-dichloro-5,5-dimethylhydantoin, N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations according to the invention can comprise, for example, in the range from 3 to 10% by weight of chlorine-containing bleach.

Formulations according to the invention can comprise one or more bleach catalysts. Bleach catalysts can be selected from bleach-boosting transition metal salts and/or transition metal complexes, such as, for example, manganese-, iron-, cobalt-, ruthenium- or molybdenum-salen complexes or -carbonyl complexes. It is also possible to use manganese, iron, cobalt, ruthenium, molybdenum, titanium, vanadium and copper complexes with nitrogen-containing tripod ligands, and also cobalt-, iron-, copper- and ruthenium-amine complexes as bleach catalysts.

Formulations according to the invention can comprise one or more bleach activators, for example N-methylmorpholinium-acetonitrile salts ("MMA salts"), trimethylammoniumacetonitrile salts, N-acylimides such as, for example, N-nonanoylsuccinimide, 1,5-diacetyl-2,2-dioxo-hexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Formulations according to the invention can comprise one or more corrosion inhibitors. In the present case, this is to be understood as meaning those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechin, hydroxyhydroquinone, gallic acid, phloroglucine or pyrogallol.

In one embodiment of the present invention, formulations according to the invention comprise in total in the range from 0.1 to 1.5% by weight of corrosion inhibitor.

Formulations according to the invention can comprise one or more builders, for example sodium sulfate.

Formulations according to the invention can comprise one or more antifoams, selected for example from silicone oils and paraffin oils.

In one embodiment of the present invention, formulations according to the invention comprise in total in the range from 0.05 to 0.5% by weight of antifoam.

Formulations according to the invention can comprise phosphonic acid or one or more phosphonic acid derivatives, for example hydroxyethane-1,1-diphosphonic acid.

The present invention further provides the use of formulations according to the invention for the machine washing of dishes and kitchen utensils. Within the context of the present invention, kitchen utensils to be mentioned are, for example, pots, pans, casseroles, also metallic objects such as, for example, skimmers, fish slices and garlic presses.

Preference is given to the use of formulations according to the invention for the machine cleaning of objects which have at least one surface made of glass, which may be decorated or undecorated. In this connection, within the context of the present invention, a surface made of glass is to be understood as meaning that the object in question has at least one section made of glass which comes into contact with the surrounding air and may be soiled upon using the object. Thus, the objects in question may be those which, like drinking glasses or glass bowls, are essentially made of glass. However, they may, for example, also be lids which have individual components made of another material, for example pot lids with edges and handle made of metal.

Surface made of glass may be decorated, for example colored or imprinted, or be undecorated.

The term "glass" includes any desired glasses, for example lead glass and in particular soda-lime glass, crystal glass and borosilicate glasses.

Preferably, machine cleaning is washing using a dishwasher (automatic dishwashing).

In one embodiment of the present invention, at least one formulation according to the invention is used for the machine cleaning of drinking glasses, vases made of glass and glass vessels for cooking.

In one embodiment of the present invention, water with a hardness in the range from 1 to 30° German hardness, preferably 2 to 25° German hardness, is used for the cleaning, where German hardness is to be understood in particular as meaning the calcium hardness.

For the rinsing as well, it is possible to use water with a hardness in the range from 1 to 30° German hardness, preferably 2 to 25° German hardness.

If formulations according to the invention are used for machine cleaning, then, even upon the repeated machine cleaning of objects which have at least one surface made of glass, only a very low tendency towards glass corrosion is observed, and then only if objects which have at least one surface made of glass are cleaned together with heavily soiled cutlery or crockery. Moreover, it is significantly less harmful to use formulation according to the invention for cleaning glass together with objects made of metal, for example together with pots, pans or garlic presses.

Furthermore, it can be observed that formulations according to the invention have a very good bleaching effect when used for washing dishes and kitchen utensils and glass surfaces.

The present invention further provides a process for the preparation of formulations according to the invention, also abbreviated to preparation process according to the invention. To carry out the preparation process according to the invention, the procedure may involve, for example, mixing, for example stirring, (A) aminocarboxylate, selected from methylglycine diacetate (MGDA), iminodisuccinic acid (IDA) and glutaminic acid diacetate (GLDA), and salts thereof, and (B) at least one alkyleneimine polymer which is covalently modified with at least one carboxylic acid or at least one derivative of a carboxylic acid or at least one derivative of carbonic acid, where up to at most 75 mol % of the nitrogen atoms of the primary and secondary amino groups of the alkyleneimine polymer have been reacted with carboxylic acid or derivative of carboxylic acid or carbonic acid, and optionally (C) sodium citrate or (D) at least one compound selected from alkali metal percarbonate, alkali metal perborate and alkali metal persulfate, and optionally further components (E) in one or more steps with one another in the presence of water, and then removing the water, completely or at least partially.

Compound (A), modified polyalkyleneimine (B) and bleach (D) are defined above.

In one embodiment of the present invention, before the water is at least partially removed, it is possible to mix with one or more further ingredients (E) for formulation according to the invention, for example with one or more surfactants, one or more enzymes, one or more builders, one or more cobuilders, in particular phosphorus-free builders, one or more alkali carriers, one or more bleaches, one or more bleach catalysts, one or more bleach activators, one or more bleach stabilizers, one or more antifoams, one or more corrosion inhibitors, one or more builders, with buffer or dye.

In one embodiment, the procedure involves removing the water completely or partly, for example to a residual moisture in the range from 0.1 to 10% by weight, from formulation according to the invention by evaporating it, in particular by spray-drying, spray-granulation or compaction.

In one embodiment of the present invention, the water is removed, completely or partially, at a pressure in the range from 0.3 to 2 bar.

In one embodiment of the present invention, the water is removed, completely or partially, at temperatures in the range from 60 to 220° C.

By means of the preparation process according to the invention, formulation according to the invention can be readily obtained.

The cleaning formulations according to the invention can be provided in liquid or solid form, in single-phase or multiphase, as tablets or in the form of other metering units, in packaged or unpackaged form. The water content of liquid formulations can vary from 35 to 90% water.

The invention is illustrated by working examples.

General: It was ensured that following the first cleaning of the test pieces in the domestic dishwasher until after weighing and visual assessment of the glasses, the test pieces were only handled using clean cotton gloves so that the weight and/or the visual impression of the test pieces was not falsified.

Data in % are % by weight unless expressly stated otherwise.

I. Formulations According to the Invention

The charge density of modified polyethyleneimines (B) was always determined as follows (see also: Horn, Prog. Colloid & Polym. Sci. 1978, 65, 251):

1 g of the (co)polymer (B) in question was dissolved in 100 ml of demineralized water. A buffer solution and aqueous HCl were used to establish a pH of 4.0, determined potentiometrically. 3 ml of an aqueous solution of toluidine blue (50 mg/l of water) were added and N/400-KPVS (potassium polyvinyl sulfate) solution (Wako) with a concentration of 0.0004 meq/ml was titrated until the color changed from blue to pink. The charge density was calculated as follows:

$$LA=0.4\cdot KV$$

where

LA: charge density of the modified polyethyleneimine (B) in question, meq/g (milliequivalent/g)

KV: consumption of the N/400-KPVS solution, ml

I.1 Preparation of Basis Mixtures

Firstly, basis mixtures were prepared from the feed materials according to table 1. The feed materials were mixed dry.

TABLE 1

Base mixtures for experiments with formulations according to the invention and comparative formulations

| | Base-1 | Base-2 | Base-3 |
|---|---|---|---|
| Protease | 2.5 | 2.5 | 2.5 |
| Amylase | 1 | 1 | 1 |
| n-$C_{18}H_{37}(OCH_2CH_2)_9OH$ | 5 | 5 | 5 |
| Polyacrylic acid $M_w$ 4000 g/mol, as sodium salt, completely neutralized | 10 | 10 | 10 |
| Sodium percarbonate (D.1) | 10.5 | 10.5 | 10.5 |
| TAED | 4 | 4 | 4 |
| $Na_2CO_3$ | 19.5 | 19.5 | 19.5 |
| Sodium citrate dihydrate | 5 | 22.5 | 19.5 |
| $Na_2Si_2O_5$ | 2 | 2 | 2 |

All data in g.

ABBREVIATIONS

MGDA: methylglycinediacetic acid as trisodium salt
TAED: N,N,N',N'-tetraacetylethylenediamine
HEDP: disodium salt of hydroxyethane(1,1-diphosphonic acid)

I.2 Preparation of Formulations According to the Invention

I.2.1 Preparation of formulations 2 to 13 according to the invention and of comparison formulations C1 to C8

Modified polyethyleneimines (B) as per table 2 were used:

TABLE 2

Modified polyethyleneimines

| Abbreviation | $M_w$ (g/mol) | Modification with | Functionalization (mol-%) | Cationic charge density (meq/g) |
|---|---|---|---|---|
| B.1.1.1 | 800 | Acrylic acid | 5 | 15 |
| B.1.1.2 | 800 | Acrylic acid | 20 | 11 |
| B.1.1.3 | 800 | Acrylic acid | 40 | 7 |
| B.1.2.1 | 2000 | Acrylic acid | 15 | 12 |
| B.1.3.1 | 5000 | Acrylic acid | 15 | 13 |
| B.1.4.1 | 50 000 | Acrylic acid | 15 | 11.5 |
| B.2.1.1 | 800 | Formic nitrile | 20 | 12 |
| B.2.2.2 | 2000 | Formic nitrile | 15 | 11 |
| B.2.3.3 | 5000 | Formic nitrile | 25 | 9 |
| B.2.4.4 | 50 000 | Formic nitrile | 10 | 14 |
| B.3.1.1 | 800 | Valeric acid | 10 | 16 |
| B.3.2.2 | 2000 | Valeric acid | 40 | 9 |
| B.3.3.3 | 5000 | Valeric acid | 15 | 14 |
| B.4.1.1 | 800 | Lauric acid | 5 | 18 |
| B.4.1.2 | 800 | Lauric acid | 15 | 14.5 |
| B.4.2.3 | 2000 | Lauric acid | 20 | 12.5 |
| B.4.3.3 | 5000 | Lauric acid | 20 | 12 |
| B.5.1.1 | 800 | Ethylene carbonate | 10 | 16 |
| B.5.1.2 | 800 | Ethylene carbonate | 20 | 13 |
| B.5.1.3 | 800 | Ethylene carbonate | 50 | 9 |
| B.5.2.4 | 2000 | Ethylene carbonate | 15 | 11.5 |
| B.5.3.2 | 5000 | Ethylene carbonate | 20 | 12.5 |
| B.5.4.1 | 50 000 | Ethylene carbonate | 10 | 14.5 |

The molecular weight $M_w$ was determined on the underlying polyethyleneimines, i.e. before the modification in each case. The functionalization refers to the sum of the primary and secondary N atoms in the polyethyleneimine in question.

Procedure:

In a 100 ml beaker, 20 ml of distilled water were introduced and modified polyethyleneimine (B) according to Tables 2 and 3 was added with stirring.

The mixture was then stirred for 10 minutes. MGDA trisodium salt (A.1), dissolved in 30 ml of water, was then added according to Table 3. This gave a clearly transparent solution. Then, base mixture according to Table 3 was added, the mixture was stirred again, and the water was evaporated.

If, during the test, the corresponding fractions of base mixture were metered separately from aqueous solution of (A.1), (B), (C.1) or (D.1), the same results were obtained as when the dried formulation with identical amounts of active ingredient was tested. It is thus not a question of the order of the metered addition.

Additionally using 2.5% by weight of polyvinyl alcohol during the compaction gives formulations with improved powder morphology (grain size, bulk density) and a reduced water absorption in the air.

II. Use of Formulations According to the Invention and Comparison Formulations for the Machine Cleaning of Glasses General: It was ensured that following the first cleaning of the test pieces in the domestic dishwasher until after weighing and visual assessment of the glasses, the test pieces were only handled using clean cotton gloves so that the weight and/or the visual impression of the test pieces was not falsified.

The testing of formulations according to the invention and comparison formulations was carried out as follows.

II.1 Test Method for Dishwasher with Continuous Operation

Dishwasher: Miele G 1222 SCL

Program: 65° C. (with prewash)

Ware: 3 "GILDE" champagne glasses, 3 "INTERMEZZO" brandy glasses

For the cleaning, the glasses were arranged in the upper crockery basket of the dishwasher. The dishwashing detergent used was in each case 25 g of formulation according to the invention or 25 g of comparison formulation as per table 2, table 2 specifying in each case the active components (A.1), base mixture, silicate (C.1 or C.2) and compound (D) or (E) and (B) of formulation according to the invention. Washing was carried out at a clear-rinse temperature of 55° C. The water hardness was in each case in the range from zero to 2° German hardness. Washing was carried out in each case for 100 wash cycles, i.e. the program was left to run 100×. The evaluation was made gravimetrically and visually after 100 wash cycles.

The weight of the glasses was determined before the start of the first wash cycle and after drying after the last wash cycle. The weight loss is the difference in the two values.

Besides the gravimetric evaluation, a visual assessment of the ware after 100 cycles in a darkened chamber with light behind a perforated plate was carried out using a grading scale from 1 (very poor) to 5 (very good). In this connection, in each case, grades were determined for patchy corrosion/clouding and/or line corrosion.

Experimental Procedure:

For the purposes of the pretreatment, the test pieces were firstly washed in a domestic dishwasher (Bosch SGS5602) with 1 g of surfactant (n-$C_{18}H_{37}(OCH_2CH_2)_{10}OH$) and 20 g of citric acid in order to remove any contaminations. The test pieces were dried, their weight was determined, and they were fixed to the mesh base insert.

In order to assess the gravimetric abrasion, the dry test pieces were weighed. The visual assessment of the test pieces was then carried out. For this, the surface of the test pieces was assessed with regard to line corrosion (glass ridges) and hazing corrosion (sheet-like hazing).

The evaluations were made in accordance with the following scheme.

Line Corrosion:

L5: no lines visible
L4: slight line formation in very few areas, fine line corrosion
L3: line corrosion in a few areas
L2: line corrosion in several areas
L1: severe line corrosion Glass Hazing L5: no hazing visible
L4: slight hazing in very few areas L3: hazing in a few areas L2: hazing in several areas L1: severe hazing over virtually the whole glass surface During the assessment, intermediate grades (e.g. L3-4) were also allowed.

II.3 Results

The results are summarized in table 3.

Only slight or even no glass corrosion was established in the inventive examples.

If, instead of water, hardness water with 2° German hardness was used for the tests, then formulations according to the invention were likewise always superior to the corresponding comparison formulations in terms of the inhibition of the glass corrosion.

TABLE 3

Results of the tests with dishwasher (continuous operation)

| Example No. | Base mixture: [g] | (A.1) [g] | (B) [mg] | Weight loss champagne glass [mg] | Weight loss brandy glass [mg] | Visual assessment champagne glass | Visual assessment brandy glass |
|---|---|---|---|---|---|---|---|
| C-1 | Base-3: 17 | 3 | — | 42.60 | 22.70 | L1-2, T1-2 | L2, T2 |
| 2 | Base-3: 17 | 3 | 48 (B.5.1.1) | 8 | 6 | L5, T5 | L4-5, T5 |
| 3 | Base-3: 17 | 3 | 24 (B.5.1.1) | 9 | 6 | L4, T5 | L4-5, T5 |
| 4 | Base-1: 17 | 3 | 24 (B.5.1.2) | 16 | 12 | L4, T4-5 | L4, T4-5 |
| 5 | Base-3: 17 | 3 | 24 (B.5.1.3) | 14 | 10 | L3-4, T4 | L4, T4 |
| 6 | Base-2: 17 | 3 | 24 (B.1.1.2) | 16 | 11 | L4, T3-4 | L3-4, T4 |
| 7 | Base-3: 17 | 3 | 24 (B.1.1.3) | 17 | 13 | L3, T3-4 | L3, T4 |
| 6 | Base-3: 17 | 3 | 12 (B.1.3.1) | 10 | 7 | L4, T4-5 | L4, T4-5 |
| 8 | Base-3: 17 | 3 | 24 (B.2.3.3) | 16 | 12 | L3, T3-4 | L2-3, T3-4 |
| 9 | Base-3: 17 | 3 | 24 (B.3.3.3) | 13 | 10 | L3, T4 | L3, T4 |
| 10 | Base-3: 17 | 3 | 24 (B.4.1.2) | 19 | 12 | L2-3, T3 | L3, T3-4 |

The invention claimed is:

1. A formulation, comprising:

(A) at least one aminocarboxylate, selected from the group consisting of methylglycine diacetate (MGDA), iminodisuccinic acid (IDA), glutaminic acid diacetate (GLDA), and a salt thereof, (B) at least one alkyleneimine polymer which is covalently modified with at least one carboxylic acid or at least one derivative of a carboxylic acid or at least one derivative of carbonic acid, where up to at most 75 mol % of the nitrogen atoms of the primary and secondary amino groups of the alkyleneimine polymer have been reacted with carboxylic acid or derivative of carboxylic acid or carbonic acid, wherein the at least one covalently modified alkyleneimine polymer (B) is at least one member selected from the group consisting of:

(B1) an alkyeneimine polymer that has been reacted with at least one ethylenically unsaturated $C_3$-$C_{10}$-carboxylic acid, (B2) an alkyeneimine polymer that has been reacted with at least one $C_5$-$C_{12}$-carboxylic acid which has no ethylenic double bond, (B3) an alkyeneimine polymer that has been reacted with at least one carbonic acid ester, and (B4) an alkyeneimine polymer that has been reacted with hydrocyanic acid and formaldehyde.

2. The formulation according to claim 1, which is free from phosphates and polyphosphates.

3. The formulation according to claim 1, which has a heavy metal content below 0.05 ppm, based on the solids content of the formulation.

4. The formulation according to claim 1, wherein the alkyleneimine polymer (B) is at least one alkyleneimine polymer in which in total 5 to 60 mol % of the nitrogen atoms of the primary and secondary amino groups of the alkyleneimine polymer have been reacted with carboxylic acid or derivative of carboxylic acid.

5. The formulation according to claim 1, which is solid at room temperature.

6. The formulation according to claim 1, which comprises water in the range from 0.1 to 10% by weight.

7. The formulation according to claim 1, wherein the covalently modified alkyleneimine polymer (B) has a cationic charge density of at least 5 meq/g.

8. The formulation according to claim 1, which comprises:

in total in the range from 1 to 50% by weight of aminocarboxylate (A), in total in the range from 0.001 to 5% by weight of covalently modified alkyleneimine polymer (B), based in each case on the solids content of the formulation.

9. A process for the preparation of formulations according to claim 1, comprising:

mixing, in the presence of water, (A) an aminocarboxylate selected from the group consisting of methylglycine diacetate (MGDA), iminodisuccinic acid (IDA), glutaminic acid diacetate (GLDA), and a salt thereof, (B) at least one alkyleneimine polymer which is covalently modified with at least one carboxylic acid or at least one derivative of a carboxylic acid or at least one derivative of carbonic acid, where up to at most 75 mol % of the nitrogen atoms of the primary and secondary amino groups of the alkyleneimine polymer have been reacted with carboxylic acid or derivative of carboxylic acid or carbonic acid wherein the at least one covalently modified alkyleneimine polymer (B) is at least one member selected from the group consisting of:

(B1) an alkyeneimine polymer that has been reacted with at least one ethylenically unsaturated C3-C10-carboxylic acid, (B2) an alkyeneimine polymer that has been reacted with at least one C5-C12-carboxylic acid which has no ethylenic double bond, (B3) an alkyeneimine polymer that has been reacted with at least one carbonic acid ester, and (B4) an alkyeneimine polymer that has been reacted with hydrocyanic acid and formaldehyde, and optionally further components, and then partially or completely removing the water, wherein the mixing is performed at least once.

10. The process according to claim 9, wherein the water is removed by spray-drying or spray-granulation.

11. The formulation according to claim 1, wherein said (B) at least one alkyleneimine polymer which is covalently modified with at least one carboxylic acid or at least one derivative of a carboxylic acid or at least one derivative of carbonic acid, where from 5 to 60 mol % of the nitrogen atoms of the primary and secondary amino groups of the alkyleneimine polymer have been reacted with carboxylic acid or derivative of carboxylic acid or carbonic acid.

12. The formulation according to claim 1, wherein the covalently modified alkyleneimine polymer (B) has a cationic charge density of from 5 to 22 meq/g.

13. The formulation according to claim 11, wherein said (B) at least one alkyleneimine polymer is covalently modified with at least one of acrylic acid, formic nitrile, valeric acid, lauric acid, and ethylene carbonate.

14. The formulation according to claim 1, wherein said (B) at least one alkyleneimine polymer is covalently modified with at least one of acrylic acid, formic nitrile, valeric acid, lauric acid, and ethylene carbonate.

* * * * *